US006113471A

United States Patent [19]

Kuebler

[11] Patent Number: 6,113,471

[45] Date of Patent: Sep. 5, 2000

[54] CHASSIS JOURNAL CORRECTOR SYSTEM

[76] Inventor: David A. Kuebler, 197 Bockes Rd., Greenfield Center, N.Y. 12833

[21] Appl. No.: 09/275,039

[22] Filed: Mar. 24, 1999

[51] Int. Cl.[7] ..... B24B 1/00

[52] U.S. Cl. ..... 451/49; 451/251; 451/243

[58] Field of Search ..... 451/28, 49, 51, 451/57, 62, 243, 251, 242, 442, 443, 446, 424, 415, 434

[56] References Cited

U.S. PATENT DOCUMENTS

| | | | |
|---|---|---|---|
| 2,415,324 | 2/1947 | Wilson . | |
| 2,612,013 | 9/1952 | Loader et al. . | |
| 4,609,312 | 9/1986 | Sverdlin . | |
| 5,437,125 | 8/1995 | Barton, II | 451/49 |
| 5,700,186 | 12/1997 | Hykes et al. | 451/251 |
| 5,730,647 | 3/1998 | Becker et al. | 451/251 |
| 5,755,615 | 5/1998 | Kiriyama | 451/49 |
| 5,863,239 | 1/1999 | Barton, II | 451/242 |
| 5,951,377 | 9/1999 | Vaughen et al. | 451/49 |

OTHER PUBLICATIONS

"On–Site Machining Equipment" Nicol & Andrew.

"In–Situ Crankshaft Repair" DeJonge, *Diesel and Gas Turbine*.

"Innovative Crankshaft Reconditioning Technique" *Marine Equipment News*.

*Primary Examiner*—Derris H. Banks

*Attorney, Agent, or Firm*—Low and Low

[57] ABSTRACT

A system for correcting and truing worn journals in engines and motors without removing the crankshaft from the apparatus, or removing the engine from the chassis of a vehicle and disassembling the same. An engine may be left in the chassis, the crankcase removed, access gained to the connecting rod sections about the crankshaft journals, and abrading and polishing members positioned about the journals to true the same as the crankshaft is rotated. The connecting rod sections include means to make the same yieldable to accommodate scoring and irregularities of worn journals as the crankshaft rotates and the journals are corrected.

6 Claims, 1 Drawing Sheet

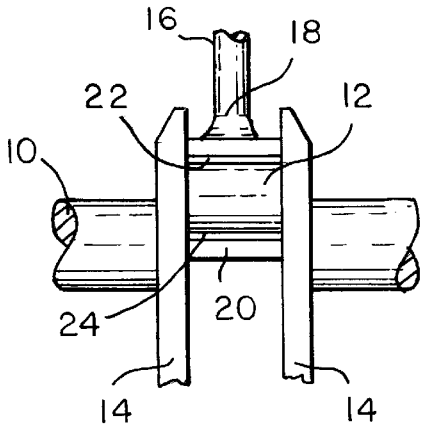
FIG. 1
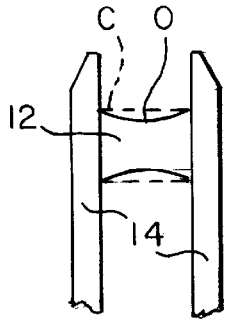
FIG. 3
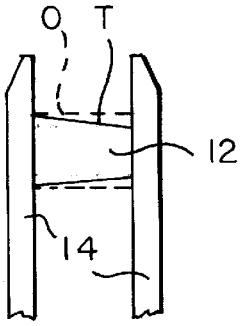
FIG. 3A
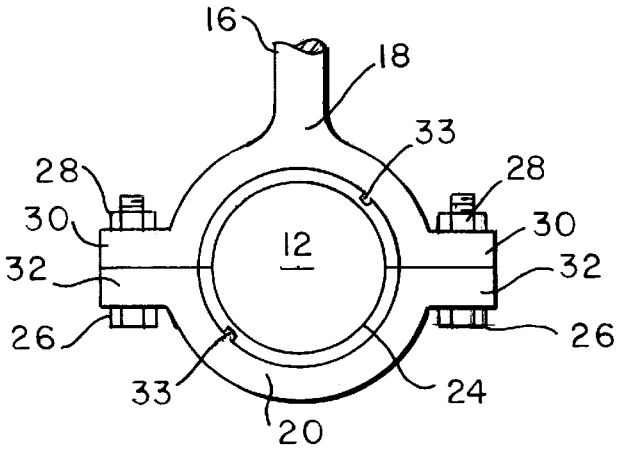
FIG. 2
FIG. 4
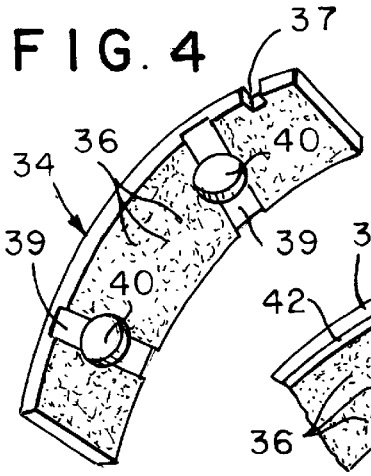
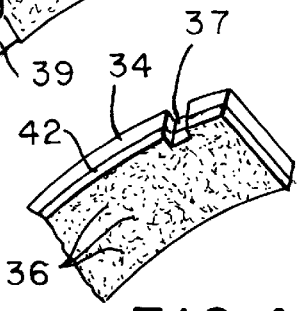
FIG. 4A
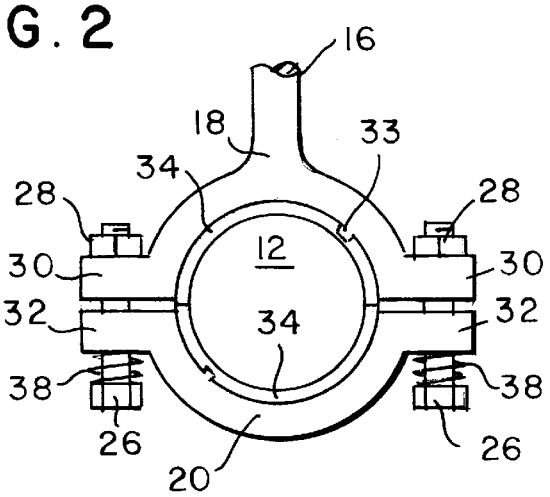
FIG. 5

CHASSIS JOURNAL CORRECTOR SYSTEM

BACKGROUND OF THE INVENTION

In the course of normal operations, and especially heavy duty use, of reciprocating piston apparatus, as internal combustion engines, piston pumps and the like, the cylindrical journals or piston crank pins between the crankshaft counterweight plates, and upon which the connecting rods to the pistons are mounted, experience significant wear. While sleeve or similar split bearings are normally interposed between the cylindrical journals and the surrounding connecting rod sections, as various well known sleeve bearings of Babbitt metal, bronze, and the like, nonetheless out-of-round wear can and does occur to the journals. In the case of an internal combustion engine, the stress applied on each power stroke of the piston is applied immediately and directly to the crankshaft journals. The same considerations apply in heavy duty pumping equipment wherein the stress of the journals is applied as the crankshaft is driven.

Out-of-round journal wear causes vibration and excess stress in the reciprocating piston apparatus, which can induce eventual or even immediate failure of the apparatus, with major loss of equipment service and operation time as well as large repair costs. While such large costs may be accommodated in the case of large industrial fixed-in-place engines or motors in a generating or pumping plant, for example, the expense is relatively staggering and impractical in the case of relatively lower-cost equipment, as consumer automobiles or smaller industrial equipment, as backhoes, and the like.

In effecting journal repair in an automobile, for example, it is presently necessary, and common practice, to physically remove the engine from the vehicle chassis, and then essentially to disassemble the engine in order to gain access to, remove, and effect regrinding and truing of worn journal connectors. This, as is evident, is a laborious and time-consuming project. Thus, after the engine is physically removed from the automobile chassis after freeing all connections thereto, thereafter, briefly stated, the engine must be disassembled, at a minimum, by removal of the crankcase, front and rear crankshaft bearings and covers, removal of the crankshaft and all connecting rods and pistons. Thence, the lower connecting rod cap sections about the journals must be removed to detach the connecting rods and pistons, thereby freeing the crankshaft as a unit for separate handling to recondition the connecting rod journals as necessary. Not only is there the aforesaid burden of disassembling the engine, but also, the crankshaft must thereafter be shipped or transported to a suitable machine shop to correct and true the journals. After the journals have been ground and retrued to desired cylindrical form, the corrected crankshaft must be returned, and thence reinstalled during full re-assembly of the engine or other reciprocating piston apparatus.

The downtime of the engine for all of this effort is necessarily great, and the costs often in the thousands of dollars, which is an exceeding burden for an automobile owner as well as for small business enterprises. The downtime and costs are much greater in the case of larger reciprocating piston engines as employed in industrial vehicles such as fork lift trucks, earthmoving equipment, front end loaders, backhoes, among many other such equipment, wherein is necessary to remove the engine from the chassis of the vehicle.

Prior efforts have been made to reduce this significant economic and operating burden in the correction of crankshaft journals. Such techniques are referred to as "on-site" journal correctors or reconditioning devices. See, for example, U.S. Pat. No. 4,609,312 to Sverdlin, or the article by the engineering firm Nicol & Andrew entitled *On-Site Machining Equipment*, among other generally similar techniques.

In such devices, it is desired that the large crankshafts not be transported at great cost, but repaired at the site, which is usually a fixed engine or motor location. In so doing, while costs of shipment are avoided, still all connecting rods, bearings, and related shaft components must be removed, and relatively complex abrading equipment is mounted about the journal. In operation, such abrading equipment is physically rotated about the journal with the axis of the journal as the center of rotation while the crankshaft is stationary. This, while physical and time-consuming transport of the crankshaft is avoided, the nonetheless difficult burden of extensive shutdown, disassembly, and reassembly is required.

BRIEF SUMMARY OF THE INVENTION

In accordance with the system and method of this invention, the crankshaft need not be removed from the engine or motor block in order to true and correct the crankshaft crank pin journals. It is only required that access be gained to the connecting rod cap sections, while the crankshaft itself as well as the pistons and upper connecting rod portions remain essentially in place in the block. The necessary access is gained merely by removing the crankcase from the bottom of the block along with associated bottom parts of the block, as oil pan, etc. Accordingly, major disassembly of the reciprocating piston apparatus is avoided, with great time and costs savings.

Arcuate abrasive members are then positioned about the journals after removal of the existing bearing sections, and the lower connecting rod cap sections replaced. Thereafter, the crankshaft is positively driven to rotate the same and thereby the crank pins revolve in usual manner with the crankshaft. In so doing, the journals rotate with respect to their surrounding abrasive sections, thereby causing the journal to be trued and polished back to desired cylindrical form and diameter, as differing abrasive sections are employed as needed, all without removal of the crankshaft from its mountings.

In accordance with the invention, the lower connecting rod cap sections are secured to the upper connecting rod sections during the correcting process such that the connecting rod sections can yield slightly as needed. Firstly, the yielding connection prevents the cap sections from being secured too tightly to impede rotation of the journals with respect to the abrasive elements, and secondly the yieldable sections accommodate any initial irregularities in the journals as the same are corrected to proper cylindrical form.

Thereafter, after the journal is rued and polished to restore its cylindrical form, new bearing sleeve sections are inserted about the journals, and which are selected to be of a slightly smaller inside diameter, thereby to accommodate the slightly reduced trued diameter of the journals. After locating and positioning the bearings, the connecting rod cap sections are replaced and the lower block portions reconnected.

It is evident that the system of the invention provides a rapid means of correcting out of round crank pins with minimum downtime and expense.

BRIEF DESCRIPTION OF THE DRAWINGS

The invention will be better understood in connection with the accompanying drawings, in which:

FIG. 1 is a side view generally illustrating a portion of a typical crankshaft having a usual pair of counterweight plates between which an illustrative crank pin journal extends and around which a sleeve bearing and connecting rod sections are secured;

FIG. 2 is an end sectional view of the crankshaft generally illustrating the bearing and the upper and lower connecting rod sections;

FIG. 3 is a diagrammatic fragmentary view showing concave wear on the journal;

FIG. 3*a* is a diagrammatic fragmentary view showing conical wear on the journal;

FIG. 4 is an orthogonal view of an abrading member of the invention;

FIG. 4*a* is an fragmentary orthogonal view of a modified abrading member of the invention; and, FIG. 5 is a view similar to FIG. 2, but showing the journal correction system in position for use.

DETAILED DESCRIPTION OF THE INVENTION

As seen in the overall and generally diagrammatic view of FIG. 1, a portion of a typical crankshaft 10 includes a crank pin or connecting rod journal 12 extending between usual counterweight plates 14, 14 of the crankshaft. A connecting rod 16 is rotatably secured to the journal 12 by means of upper connecting rod semi-circular section 18 extending from the piston (not shown) and a lower connecting rod semi-circular cap section 20, the two sections surrounding the crank pin 12. Bearing means, as a conventional sleeve bearing formed in two semi-circular sections 22, 24, is interposed between the connecting rod sections and the crank pin 12.

To permit assembly about and disassembly from the journal 12, the connecting rod sections 18, 20, are conventionally bolted together as by a pair of bolts 26 and nuts 28 extending through aligned bores in mating ears 30, 32, on the upper and lower semicircular sections 18, 20, as seen in FIG. 2. As is well known in the art, the effective inside diameter of the semi-circular sections 18, 20, the outside diameter of the journal 12, and the cooperating faces of bearing halves 22, 24 are sized so as to embrace the journal 12 while permitting relative rotation thereof with respect to the connecting rod as the crankshaft rotates.

While only a single crankpin and connecting rod is shown in FIG. 1, in any engine or other reciprocating piston apparatus there are usually a plurality of pistons having a like number of crankpins and connecting rods associated therewith and spaced along the crankshaft, and which are all similarly constructed. Also, as is conventional in the art, means are provided to prevent relative rotation between the connecting rod and the bearing sections as the engine operates, as by a lug 33 on the connecting rod sections engaging with complementary notches on the bearing members, thereby permitting the crank pins 12 to revolve with respect to the bearings. Also, various means including ports and passages are routinely provided to ensure oil flow and lubrication about the journals as the crankshaft rotates.

In the course of reciprocating piston apparatus operation, wherein the stress forces on the crank pin are considerable and unrelenting from every vector direction, wear occurs, causing the crank pin become scored or to lose its original polished cylindrical configuration. Such wear may cause various out-of-round or non-cylindrical conditions. As illustratively shown in exaggerated form in FIG. 3, the journal 12 may wear to a concave exterior as shown at "C" from its original fully cylindrical form as indicated by dashed lines at "O". Or, in like manner, stress and bearing wear may cause a reforming of the crank pin 12 illustratively to a tapered configuration as seen in exaggerated manner at "T" in FIG. 3A.

While journal wear is exaggerated in FIGS. 3 and 3A, an out-of-cylindrical journal condition of only a few thousandths of an inch, as 0.002", let alone an even greater out-of-round condition approaching 0.008", quickly leads to excessive vibration and accelerated wear. There is also the danger of fracture of the crank pin and catastrophic engine failure, with unacceptably high costs of downtime and repair, as above noted.

For this reason, detection of journal wear requires prompt correction and truing. By the present invention, this is achieved at minimum costs as compared with present practice.

In accordance with the invention, and with an example of an automobile or other vehicular engine in a chassis, to retrue a worn journal 12 without time-consuming and expensive removal of the entire engine from the vehicle chassis, or entire removal of the crankshaft 10 from the engine, a series of steps are followed. Thus, after draining oil from the engine, and removing the oil filter (if mounted beneath the engine), the crankcase, oil pan or like lower member of the engine or motor block is removed, thereby to expose the crankshaft 10. Thereafter, the bolts 26, 26 and nuts 28, 28 securing the connecting rod upper section 18 and lower cap section 20 are removed, thereby permitting connecting rod lower cap section 20 to fall free.

At this time, the bearing sleeve halves 22, 24 can be removed for ultimate replacement, the lower bearing half falling free if not removed with the lower connecting rod cap section 20. The connecting rod 16 with upper section 18 connected to the piston is then pushed upwardly in its cylinder to expose the upper bearing half 22 for ready removal from about the upper portion of the journal 12.

The journal 12 is now exposed and after cleaning can be electronically or mechanically inspected, and its condition determined as to scoring, excessive wearing, or out-of-roundness. While not necessarily visible to the naked eye, the wear on the crank pin altering its initial cylindrical form can be determined as by a micrometer or electronic measurement equipment.

A chief feature of the instant in-chassis journal corrector system is the provision of substantially semi-circular abrading and polishing members 34 to effect truing of the journals 12, one of which is seen in FIG. 4. The abrading member is formed from steel, bronze, or like metal. Abrasive material 36, as Carborundum® or other well known abrasives in powder or particulate form, is bonded or adhered to the major portion of the concave inner surface of member 34.

Abrading members 34 also have means to preclude rotation thereof with the crank pin in a manner similar to that of bearing sections, as typically a notch 37 which cooperates with the lugs 33 on the connecting rod upper and lower sections 18, 20. The abrading member 34 is sized to fit within the connecting rod sections much as a bearing member section, but the member 34 and the abrading surface thereof are radially dimensioned in thickness as desired to effect the needed truing and polishing of the journal pin 12.

Thus, two such abrading and polishing members are provided having together a given internal diameter, and a series of sets of such members of differing internal diameters are employed as necessary, depending upon the correction needed for differing crank pins. Further, while the abrasive may be directly bonded to the abrading members 34 as seen, for ease in manufacturing, the abrasive and polishing material may if desired be deposited upon a thin substrate, as at 42 in FIG. 4A, and this substrate then bonded to the arcuate members 34.

After wiping or cleaning the bearing seats on the connecting rod semi-circular sections, two abrading sections 34 are placed about the journal as seen in FIG. 5. The inner diameter sizing may be such that the lower connecting rod section does not tightly seat upon the upper connecting rod section at the facing ears 30, 32, but rather has a slight gap thereat. It will be seen that if the ears 30, 32 tightly abut, as is usual with bearing halves present, there would be no means by which further clamping pressure could be exerted upon the journal for abrading and polishing purposes, once the journal 12 was abraded sufficiently to exactly match the inner diameter of the facing abrading members 34.

Accordingly, the present journal corrector system further includes a pair of compression springs 38, 38 (FIG. 5) which are placed about the ends of bolts 26, 26 and rest upon the upper connecting rod section ears 30, 30. The nuts 28, 28 are tightened sufficiently to cause the springs to apply pressure to the connecting rod semi-circular section and the abrading members 34, 34 about the journal. The springs thus accommodate any extra thickness of the abrading members 34, as compared to the ordinary sleeve bushings used when the engine is operational. It will also be seen that in the event of surface irregularities on the journal, the springs permit slight yielding outwardly of the connecting rod sections as the crankshaft is driven to rotate the journal within the surrounding abrading members, should scoring or other surface irregularities on the journal 12 provide a non-cylindrical surface in engagement with the abrading members.

Accordingly, with the abrading members in place, the oil pan or other lower crankcase member is replaced along with a new oil filter. The crankcase is filled with a proper amount of lubricant, as light oil, kerosene or diesel fuel. With spark plugs or fuel injectors removed, the crankshaft is driven as by the engine starting motor to revolve the journal 12 within the connecting rod sections, thereby effecting abrading and polishing with selected members 34 to restore the precise cylindrical nature of the journal 12.

Depending upon the nature and extent of wear, differing fineness of abrasives are provided on the respective set of abrading members 34, and which can be interchanged as needed to effect the desired truing and polishing of the crank pin 12. If only a relative polishing is required, a finer abrasive is employed and only a short time is needed to effect correction. If the wear is greater, requiring abrading or cutting away out-of-round areas, a longer rotation period is required, and with differing grades of abrasive as needed.

As the journal needs to be lubricated as the correction is effected thereon, both to permit ready relative rotation of the members, and also to flush away abraded particles from the journal, the abrading members 34 on their working faces are provided with oil flush or drain channels 39, as seen in FIG. 4. The channels 39 are recessed slightly below the inner abrading surface of the members 34. Two such channels on each semi-circular abrading member are seen in FIG. 4. Further, each channel is relieved to the outside by ports or apertures 40 in the channels, thereby providing additional paths for supply and exhaust of lubricant as oil or kerosene as the crankshaft is rotated, as well as outflow of microscopic particles as the journal is corrected. Preferably, a simple filter sock on the oil sump will collect metallic particles and prevent recirculation through the engine.

After polishing of the journal 12, the lower cap 20 is removed, the springs 38 also removed, and the semi-circular abrasive members 34 also removed. After cleaning of all exposed parts, new bearing sleeve elements of a correct size are immersed in oil and positioned about the pin 12, and the journal sections 18, 20 reconnected by the bolts and cap nuts, suitably tightened to torqueing specifications. The crankcase and oil pan are replaced, and the engine is in good order for use, all without having removed the engine from the chassis of the vehicle, and without full disassembly of the engine or motor.

While I have described preferred embodiments of my invention, it will be seen that the principles and elements thereof may take other forms than those specifically shown within the spirit and scope of my invention.

What I claim is:

1. An in-chassis system for truing worn crankshaft connecting rod journals in reciprocating piston engine and motor apparatus without removing the crankshaft from the apparatus, wherein the connecting rods include mating semi-circular elements embracing arcuate split bearings which in turn embrace the connecting rod crankshaft journal, said semi-circular elements including a pair of bolts and nuts connecting the same, comprising:

a pair of semi-circular members dimensioned to fit about the crankshaft journal after removal of the bearing therefrom;

said members having abrasive and polishing material on the inner arcuate faces thereof which surround the journal when placed thereabout.

2. The in-chassis system for truing worn crankshaft connecting rod journals of claim 1, wherein said semi-circular abrading and polishing members are provided with lubricant flow channels on the inner faces thereof.

3. The in-chassis system for truing worn crankshaft connecting rod journals of claim 1 wherein said flow channels include a port extending generally radially through the abrading member to facilitate lubricant flow during abrading and polishing.

4. The in-chassis system for truing worn crankshaft connecting rod journals of claim 1 further including a pair of compression springs for placing about the bolts for respective interposition between the nuts and a connecting rod section, thereby to permit relative separating movement of the connecting rod sections in response to journal irregularities during abrading and polishing.

5. The in-chassis system for truing worn crankshaft connecting rod journals of claim 1, wherein, said semi-circular abrading and polishing members are provided with lubricant flow channels on the inner faces thereof, and, a pair of compression springs for placing about the bolts for respective interposition between the nuts and a connecting rod section, thereby to permit relative separating movement of the connecting rod sections in response to journal irregularities during abrading and polishing.

6. The in-chassis system for truing worn crankshaft connecting rod journals of claim 5, wherein said flow channels include a port extending generally radially through the abrading member to facilitate lubricant flow during abrading and polishing.

* * * * *

UNITED STATES PATENT AND TRADEMARK OFFICE

CERTIFICATE OF CORRECTION

PATENT NO. : 6,113,471

DATED : September 5, 2000

INVENTOR(S) : David A. Kuebler

It is certified that error appears in the above-identified patent and that said Letters Patent is hereby corrected as shown below:

On the title page, Item [54] and the top of Col. 1, line 1, title should read:

--IN-CHASIS JOURNAL CORRECTOR SYSTEM--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*